US008967380B2

(12) United States Patent
Moncrief et al.

(10) Patent No.: US 8,967,380 B2
(45) Date of Patent: Mar. 3, 2015

(54) CARTON WITH REINFORCING INSERT

(71) Applicant: Graphic Packaging International, Inc., Atlanta, GA (US)

(72) Inventors: Frank N. Moncrief, Acworth, GA (US); Raymond S. Kastanek, Kennesaw, GA (US); Mark Baldino, Marietta, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 20 days.

(21) Appl. No.: 13/871,147

(22) Filed: Apr. 26, 2013

(65) Prior Publication Data

US 2013/0284628 A1 Oct. 31, 2013

Related U.S. Application Data

(60) Provisional application No. 61/687,593, filed on Apr. 27, 2012.

(51) Int. Cl.
*B65D 71/38* (2006.01)
*B65D 5/50* (2006.01)
(Continued)

(52) U.S. Cl.
CPC ..... *B65D 71/38* (2013.01); *B65D 5/5028* (2013.01); *B65D 5/32* (2013.01); *B31B 7/00* (2013.01); *B65D 71/36* (2013.01); *B65D 2571/00141* (2013.01); *B65D 2571/00265* (2013.01); *B65D 2571/00302* (2013.01);
(Continued)

(58) Field of Classification Search
CPC ..... B65D 5/308; B65D 5/4608; B65D 2571/066; B65D 2571/00666
USPC ..... 206/427, 433; 229/117.13, 117.16, 229/117.17, 199, 242
See application file for complete search history.

(56) References Cited

U.S. PATENT DOCUMENTS 1,925,102 A 9/1933 Levkoff
2,005,924 A 6/1935 Wilson
(Continued)

FOREIGN PATENT DOCUMENTS

CA 873185 6/1971
EP 0 066 029 12/1982
(Continued)

OTHER PUBLICATIONS

International Search Report and Written Opinion, mailed Aug. 8, 2013, for related application No. PCT/US2013/038334.

*Primary Examiner* — Bryon Gehman
(74) *Attorney, Agent, or Firm* — Womble Carlyle Sandridge & Rice, LLP

(57) ABSTRACT

A carton for holding a plurality of containers. The carton comprises a plurality of panels comprising a top panel. A plurality of end flaps are at least partially overlapped with respect to one another to thereby at least partially form a closed end of the carton. The plurality of end flaps can comprise a top end flap foldably connected to the top panel. A reinforcing insert can comprise a central panel and at least one reinforcing end panel foldably connected to the central panel. At least one reinforcing end flap can be foldably connected to the at least one reinforcing end panel. A handle can comprise at least a first handle feature in the top end flap and a second handle feature in the reinforcing end panel. The second handle feature can be generally aligned with the first handle feature.

32 Claims, 9 Drawing Sheets

(51) Int. Cl.
*B65D 5/32* (2006.01)
*B31B 7/00* (2006.01)
*B65D 71/36* (2006.01)

(52) U.S. Cl.
CPC ..... *B65D 2571/0045* (2013.01); *B65D 2571/0053* (2013.01); *B65D 2571/0066* (2013.01); *B65D 2571/00728* (2013.01); *B65D 2571/00814* (2013.01)
USPC ..... 206/427; 229/117.16; 229/199

(56) References Cited

U.S. PATENT DOCUMENTS 2,067,749 A 1/1937 Zimmerman et al.
2,115,673 A 4/1938 Stompe
2,196,502 A 4/1940 Kells
2,299,027 A 10/1942 Novak
2,386,905 A 10/1945 Meitzen
2,648,484 A 8/1953 Belsinger
2,669,351 A 2/1954 Carson et al.
2,754,047 A 7/1956 Schmidt et al.
3,078,032 A 2/1963 Robinson et al.
3,128,010 A 4/1964 Forrer
3,133,634 A 5/1964 Bozdar
3,173,596 A 3/1965 Aust et al.
3,178,242 A 4/1965 Ellis et al.
3,228,582 A 1/1966 Osberg
3,263,861 A 8/1966 Carr
3,265,283 A 8/1966 Farquhar
3,300,115 A 1/1967 Schauer
3,332,594 A 7/1967 De Capua
3,346,167 A 10/1967 Schmidt
3,356,279 A 12/1967 Root
3,517,858 A 6/1970 Farquhar
3,533,549 A 10/1970 Gilchrist
3,540,581 A 11/1970 Koolnis
3,825,170 A 7/1974 Aust et al.
3,904,036 A 9/1975 Forrer
4,155,449 A 5/1979 Bryne
4,214,660 A 7/1980 Hunt, Jr.
4,222,485 A 9/1980 Focke
4,256,226 A 3/1981 Stone
4,318,474 A 3/1982 Hasegawa
4,364,509 A 12/1982 Holley, Jr. et al.
4,375,258 A 3/1983 Crayne et al.
4,376,509 A 3/1983 Schaffer
4,378,877 A 4/1983 Botterman et al.
4,396,143 A 8/1983 Killy
4,417,655 A 11/1983 Forbes, Jr.
4,417,661 A 11/1983 Roccaforte
4,538,759 A 9/1985 Dutcher
4,577,762 A 3/1986 Kuchenbecker
4,588,084 A 5/1986 Holley, Jr.
4,605,128 A 8/1986 Rieke
4,621,766 A 11/1986 McClure
4,658,984 A 4/1987 Brunner
4,757,938 A 7/1988 Collins
4,817,866 A 4/1989 Wonnacott
4,830,267 A 5/1989 Wilson
4,890,440 A 1/1990 Romagnoli
4,949,845 A 8/1990 Dixon
4,967,901 A 11/1990 Wood
4,974,771 A 12/1990 Lavery
5,072,876 A 12/1991 Wilson
5,101,642 A 4/1992 Alexandrov
5,119,985 A 6/1992 Dawson et al.
5,137,211 A 8/1992 Summer et al.
5,219,229 A 6/1993 Sengewald
5,246,112 A 9/1993 Stout et al.
5,249,681 A 10/1993 Miller
5,297,725 A 3/1994 Sutherland
5,320,277 A 6/1994 Stout et al.
5,333,734 A 8/1994 Stout et al.
5,350,109 A 9/1994 Brown et al.
5,425,474 A 6/1995 Dalea et al.
5,427,241 A 6/1995 Sutherland
5,482,185 A 1/1996 McNaughton
5,482,203 A 1/1996 Stout
5,505,372 A 4/1996 Edson et al.
5,577,612 A 11/1996 Chesson et al.
5,588,585 A 12/1996 McClure
5,597,114 A 1/1997 Kramedjian et al.
5,622,309 A 4/1997 Matsuda et al.
5,639,017 A 6/1997 Fogle
5,664,683 A 9/1997 Brody
5,690,213 A 11/1997 Matsumura
5,690,230 A 11/1997 Griffith
5,704,470 A 1/1998 Sutherland
5,794,778 A 8/1998 Harris
5,826,783 A 10/1998 Stout
5,873,516 A 2/1999 Boggs
5,875,961 A 3/1999 Stone et al.
5,881,884 A 3/1999 Podosek
5,921,398 A 7/1999 Carroll
5,924,559 A 7/1999 Carrel et al.
5,927,498 A 7/1999 Saam
6,050,402 A 4/2000 Walter
6,170,741 B1 1/2001 Skolik et al.
6,176,419 B1 1/2001 Holley, Jr.
6,250,542 B1 6/2001 Negelen
6,283,293 B1 9/2001 Lingamfelter
6,302,320 B1 10/2001 Stout
6,409,077 B1 6/2002 Telesca et al.
D459,927 S 7/2002 Flowers et al.
6,471,120 B1 10/2002 Vogel
6,478,219 B1 11/2002 Holley, Jr.
6,484,903 B2 11/2002 Spivey et al.
6,550,615 B2 4/2003 Lingamfelter
6,557,699 B1 5/2003 Focke et al.
6,578,736 B2 6/2003 Spivey
6,604,677 B1 8/2003 Sutherland et al.
6,631,803 B2 10/2003 Rhodes et al.
6,669,083 B2 12/2003 Bates
6,715,639 B2 4/2004 Spivey
6,752,262 B1 6/2004 Boriani et al.
6,789,673 B2 9/2004 Lingamfelter
6,848,573 B2 2/2005 Gould et al.
6,866,186 B2 3/2005 Fogle et al.
6,902,104 B2 6/2005 Holley, Jr. et al.
6,918,487 B2 7/2005 Harrelson
6,926,193 B2 8/2005 Smalley
6,929,172 B2 8/2005 Bates et al.
6,932,265 B2 8/2005 Sax et al.
6,968,992 B2 11/2005 Schuster
6,969,172 B2 11/2005 Actis-Datta
6,974,072 B2 12/2005 Harrelson
6,991,107 B2 1/2006 Harrelson
6,997,316 B2 2/2006 Sutherland
7,000,803 B2 2/2006 Miller
7,073,665 B2 7/2006 Auclair et al.
7,104,435 B2 9/2006 Holley, Jr.
7,134,593 B2 11/2006 Harrelson
7,159,759 B2 1/2007 Sutherland
7,225,930 B2 6/2007 Ford et al.
7,422,104 B2 9/2008 Perkinson
7,478,743 B2 1/2009 Holley, Jr.
7,604,157 B2 10/2009 Zammit et al.
7,699,163 B2 4/2010 Gomes et al.
7,699,215 B2 4/2010 Spivey, Sr.
8,356,743 B2 1/2013 Spivey, Sr.
8,356,744 B2 1/2013 Brand et al.
8,376,214 B2 2/2013 Spivey, Sr. et al.
8,387,855 B2 3/2013 Brand
8,439,194 B2 5/2013 Spivey
8,453,919 B2 * 6/2013 Eckermann et al. ..... 229/117.13
8,459,534 B2 6/2013 Bradford
8,496,109 B2 * 7/2013 Smalley et al. ..... 206/433
2002/0029991 A1 3/2002 Lingamfelter
2002/0070139 A1 6/2002 Bates
2002/0088820 A1 7/2002 Spivey
2002/0088821 A1 7/2002 Spivey et al.
2002/0185499 A1 12/2002 Harrelson et al.
2003/0006158 A1 1/2003 Skolik et al.
2003/0136820 A1 7/2003 Negelen

(56) References Cited

U.S. PATENT DOCUMENTS

| | | | |
|---|---|---|---|
| 2003/0141313 | A1 | 7/2003 | Bates |
| 2003/0150759 | A1 | 8/2003 | White, Jr. |
| 2003/0192907 | A1 | 10/2003 | Bates |
| 2004/0040334 | A1 | 3/2004 | Rusnock |
| 2004/0060972 | A1 | 4/2004 | Harrelson |
| 2004/0089575 | A1 | 5/2004 | Lingamfelter |
| 2004/0089671 | A1 | 5/2004 | Miller |
| 2004/0099558 | A1 | 5/2004 | Oliff et al. |
| 2004/0155098 | A1 | 8/2004 | Harrelson |
| 2004/0188277 | A1 | 9/2004 | Auclair |
| 2004/0188300 | A1 | 9/2004 | Sutherland |
| 2004/0188508 | A1 | 9/2004 | Holley, Jr. et al. |
| 2005/0023170 | A1 | 2/2005 | Lingamfelter |
| 2005/0092820 | A1 | 5/2005 | Chekroune |
| 2005/0115843 | A1 | 6/2005 | Harrelson |
| 2005/0126947 | A1 | 6/2005 | Holley, Jr. |
| 2005/0167291 | A1 | 8/2005 | Sutherland |
| 2005/0167478 | A1 | 8/2005 | Holley, Jr. |
| 2005/0189405 | A1 | 9/2005 | Gomes et al. |
| 2005/0263574 | A1 | 12/2005 | Schuster |
| 2006/0054522 | A1 | 3/2006 | Kline et al. |
| 2006/0081691 | A1 | 4/2006 | Smalley |
| 2006/0091193 | A1 | 5/2006 | DeBusk |
| 2006/0118606 | A1 | 6/2006 | Holley, Jr. et al. |
| 2006/0131370 | A1 | 6/2006 | Bates |
| 2006/0175386 | A1 | 8/2006 | Holley, Jr. |
| 2006/0231441 | A1 | 10/2006 | Gomes et al. |
| 2006/0231600 | A1 | 10/2006 | Holley |
| 2006/0249413 | A1 | 11/2006 | Auclair et al. |
| 2006/0278689 | A1 | 12/2006 | Boshinski et al. |
| 2007/0007325 | A1 | 1/2007 | Suzuki et al. |
| 2007/0029371 | A1 | 2/2007 | Theelen |
| 2007/0108261 | A1 | 5/2007 | Schuster |
| 2007/0131748 | A1 | 6/2007 | Brand |
| 2007/0164093 | A1 | 7/2007 | Spivey et al. |
| 2007/0181658 | A1 | 8/2007 | Sutherland |
| 2007/0205255 | A1 | 9/2007 | Dunn |
| 2007/0210144 | A1 | 9/2007 | Brand |
| 2007/0251982 | A1 | 11/2007 | Brand |
| 2007/0295790 | A1 | 12/2007 | Zammit et al. |
| 2008/0023535 | A1 | 1/2008 | Holley, Jr. |
| 2008/0048014 | A1 | 2/2008 | Bates |
| 2008/0110967 | A1 | 5/2008 | Walling |
| 2008/0128479 | A1 | 6/2008 | Bates et al. |
| 2008/0203143 | A1 | 8/2008 | Holley |
| 2009/0282843 | A1 | 11/2009 | Brand |
| 2010/0044420 | A1 | 2/2010 | Brand et al. |
| 2010/0122999 | A1 | 5/2010 | Brand |
| 2010/0237138 | A1 | 9/2010 | Bradford |
| 2011/0011924 | A1 | 1/2011 | Spivey et al. |
| 2011/0049228 | A1 | 3/2011 | Brand |
| 2011/0068160 | A1 | 3/2011 | Brand et al. |
| 2011/0290692 | A1 | 12/2011 | Spivey, Sr. |
| 2012/0091021 | A1 | 4/2012 | Smalley |

FOREIGN PATENT DOCUMENTS

| | | |
|---|---|---|
| EP | 1 433 714 | 6/2004 |
| EP | 1 698 565 | 9/2006 |
| FR | 2 549 010 | 1/1985 |
| GB | 2 264 101 | 8/1993 |
| JP | 2002-128064 | 5/2002 |
| JP | 2006-111342 | 4/2006 |
| JP | 2007-055630 | 3/2007 |
| JP | 2007-532421 | 11/2007 |
| JP | 2010-149927 | 7/2010 |
| KR | 10-0154124 | 2/1999 |
| KR | 10-0371048 | 8/2003 |
| WO | WO 96/21603 | 7/1996 |
| WO | WO 96/29260 | 9/1996 |
| WO | WO 99/28198 | 6/1999 |
| WO | WO 99/64301 | 12/1999 |
| WO | WO 00/03937 | 1/2000 |
| WO | WO 02/47990 | 6/2002 |
| WO | WO 2004/043790 | 5/2004 |
| WO | WO 2005/051781 | 6/2005 |
| WO | WO 2005/100175 | 10/2005 |
| WO | WO 2006/050210 | 5/2006 |
| WO | WO 2006/050316 | 5/2006 |
| WO | WO 2007/076544 | 7/2007 |

* cited by examiner

CARTON WITH REINFORCING INSERT

CROSS-REFERENCE TO RELATED APPLICATIONS

This application claims the benefit of U.S. Provisional Patent Application No. 61/687,593, filed Apr. 27, 2012.

INCORPORATION BY REFERENCE

The disclosures of U.S. Provisional Patent Application No. 61/687,593, which was filed on Apr. 27, 2012, and U.S. patent application Ser. No. 13/419,740, which was filed on Mar. 14, 2012, are hereby incorporated by reference for all purposes as if presented herein in their entirety.

BACKGROUND OF THE DISCLOSURE

The present disclosure generally relates to cartons for holding beverage containers or other types of articles. More specifically, the present disclosure relates to cartons having a reinforcing insert.

SUMMARY OF THE DISCLOSURE

In general, one aspect of the disclosure is directed to a carton for holding a plurality of containers. The carton comprises a plurality of panels that extends at least partially around an interior of the carton. The plurality of panels comprises a top panel. A plurality of end flaps are respectively foldably connected to respective panels of the plurality of panels. The plurality of end flaps are at least partially overlapped with respect to one another to thereby at least partially form a closed end of the carton. The plurality of end flaps can comprise a top end flap foldably connected to the top panel. A reinforcing insert can comprise a central panel and at least one reinforcing end panel foldably connected to the central panel. The top panel at least partially overlaps the central panel, and the top end flap at least partially overlaps the reinforcing end panel. At least one reinforcing end flap can be foldably connected to the at least one reinforcing end panel. A handle can comprise at least a first handle feature in the top end flap and a second handle feature in the reinforcing end panel. The second handle feature can be generally aligned with the first handle feature.

In another aspect, the disclosure is generally directed to, in combination, a carton blank and a reinforcing insert blank for forming a carton for holding a plurality of containers. The carton blank comprises a plurality of panels comprising a top panel and a plurality of end flaps respectively foldably connected to respective panels of the plurality of panels. The plurality of end flaps are for being at least partially overlapped with respect to one another to thereby at least partially form a closed end of the carton formed from the carton blank. The plurality of end flaps comprises a top end flap foldably connected to the top panel. The carton blank also can comprise a first handle feature in the top end flap. The reinforcing insert blank comprises a central panel, at least one reinforcing end panel foldably connected to the central panel, at least one reinforcing end flap foldably connected to the at least one reinforcing end panel, and a second handle feature in the reinforcing end panel. The top panel is for at least partially overlapping the central panel, the top end flap is for at least partially overlapping the reinforcing end panel, and the second handle feature is for being generally aligned with the first handle feature when the carton is formed from the carton blank. The first handle feature and the second handle feature can at least partially form a handle in the closed end when the carton is formed from the carton blank.

In another aspect, the disclosure is generally directed to a method of forming a carton for holding a plurality of containers. The method comprises obtaining a carton blank comprising a plurality of panels comprising a top panel, a plurality of end flaps comprising a top end flap foldably connected to the top panel, and a first handle feature in the top end flap. The method further can comprise obtaining a reinforcing insert blank comprising a central panel, at least one reinforcing end panel foldably connected to the central panel, at least one reinforcing end flap foldably connected to the at least one reinforcing end panel, and a second handle feature in the reinforcing end panel. The method also can comprise forming a reinforcing insert from the reinforcing insert blank by at least partially overlapping the at least one reinforcing end flap with the at least one reinforcing end panel, positioning the reinforcing insert on the carton blank so that the top panel at least partially overlaps the central panel and the top end flap at least partially overlaps the reinforcing end panel, and forming an interior of the carton at least partially defined by the plurality of panels. The forming the interior of the carton can comprise forming an open-ended sleeve. The method further can comprise at least partially closing an end of the carton by at least partially overlapping the plurality of end flaps with respect to one another. The at least partially closing the end of the carton can comprise forming a handle in the end of the carton from at least the first handle feature and the second handle feature. The second handle feature can be generally aligned with the first handle feature.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "lower," "bottom," "upper," and "top" indicate orientations determined in relation to fully erected and upright cartons.

Figure 1:
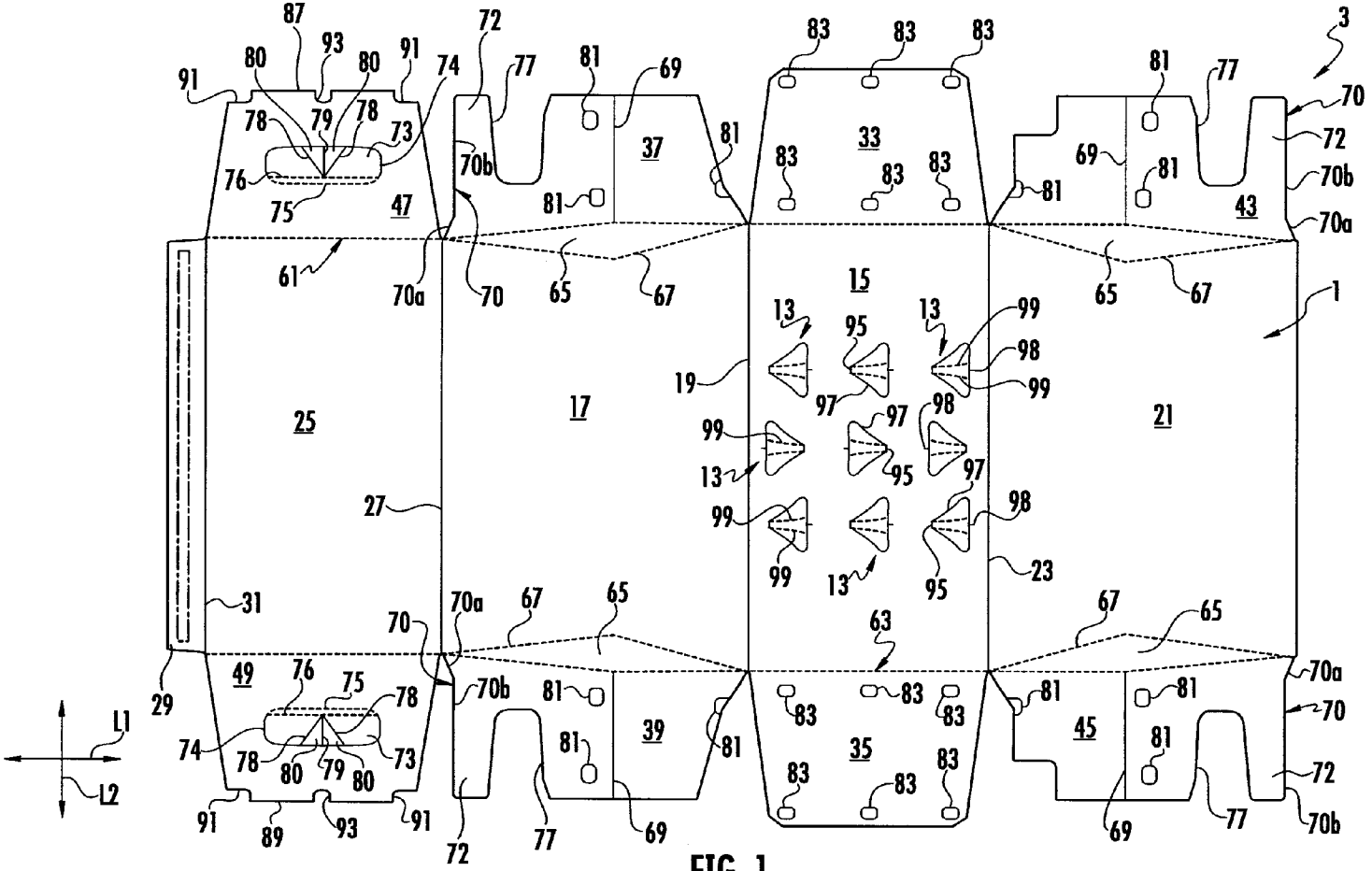
FIG. 1 is an exterior plan view of a carton blank used to form a carton according to a first exemplary embodiment of the disclosure.
Figure 2:
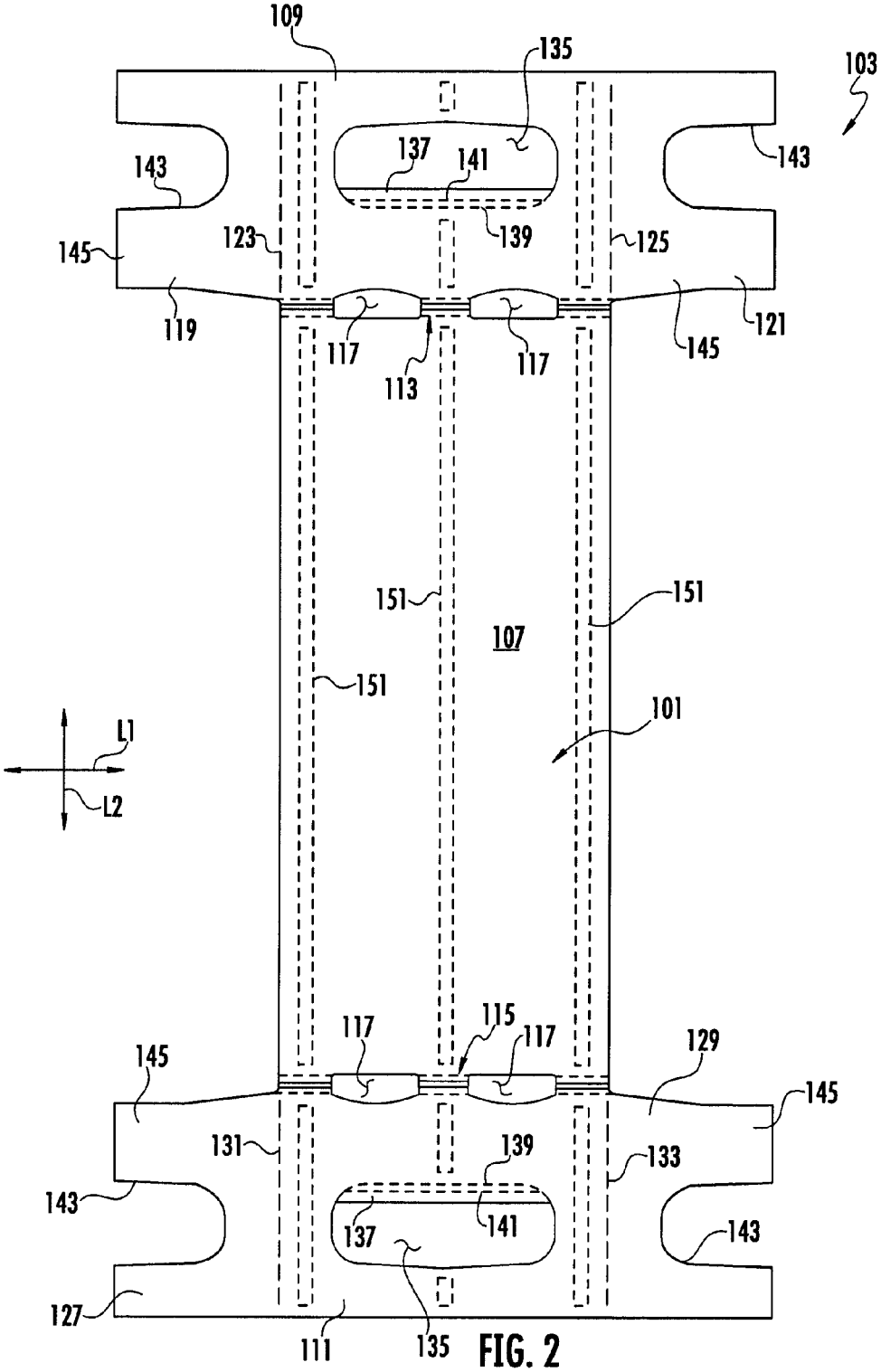
FIG. 2 is an exterior plan view of a reinforcing insert blank used to form a reinforcing insert in the carton according to the first exemplary embodiment of the disclosure.
Figure 5:
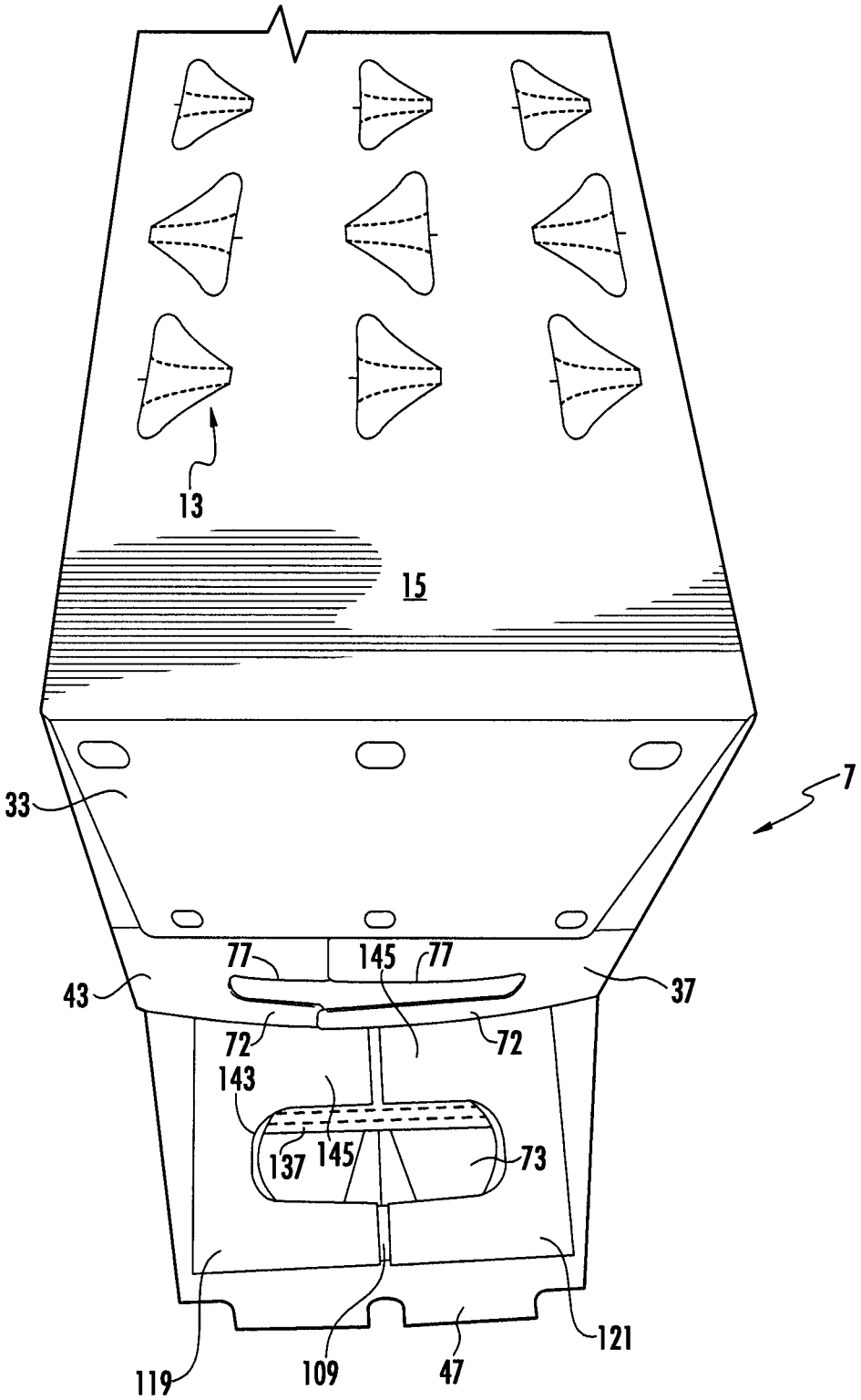
FIG. 5 is a perspective view of a partially-closed end of the sleeve of FIG. 4.
Figure 6A:
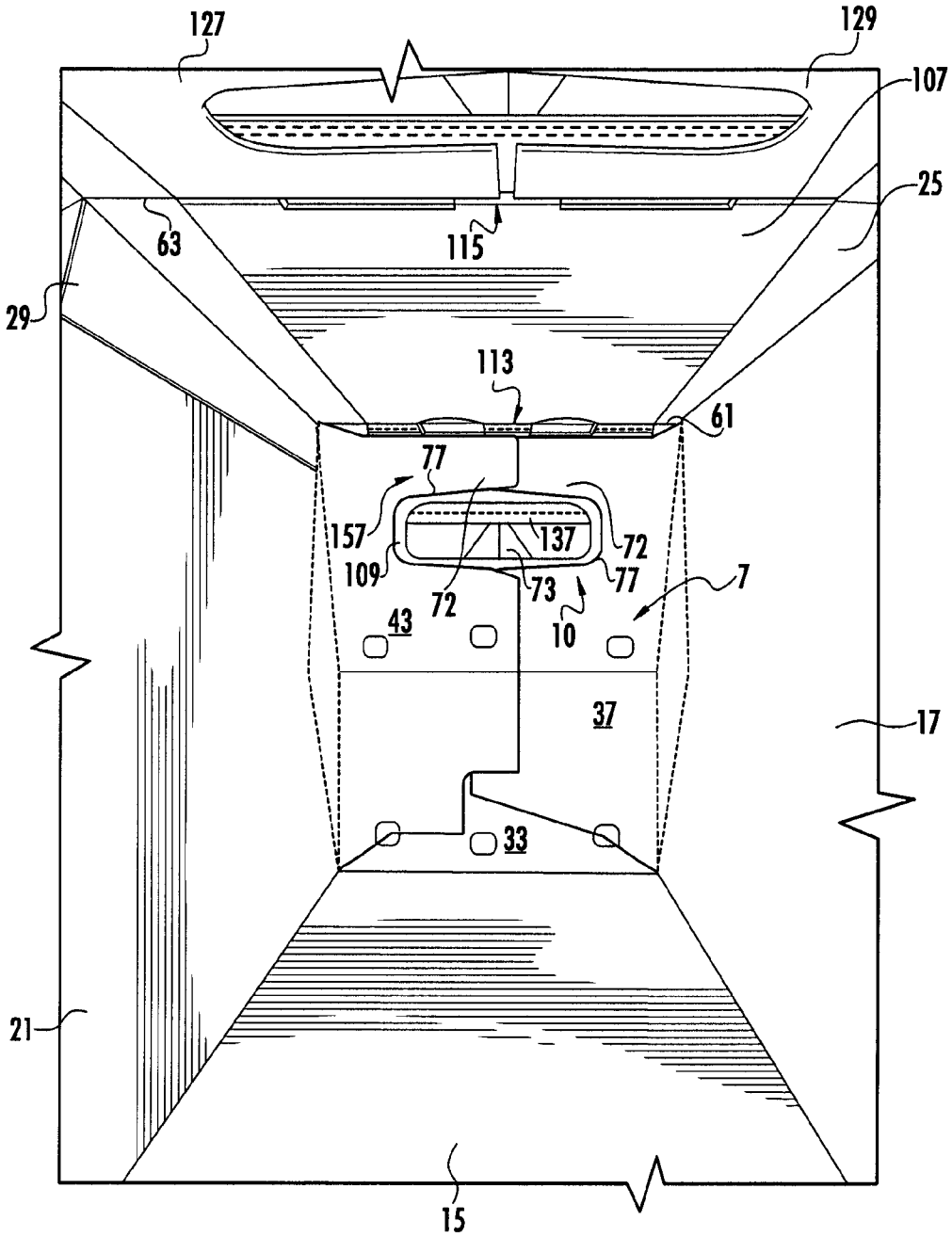
FIGS. 6A and 6B are interior views of the partially-erected carton with one closed end according to the first exemplary embodiment of the disclosure.
Figure 6B:
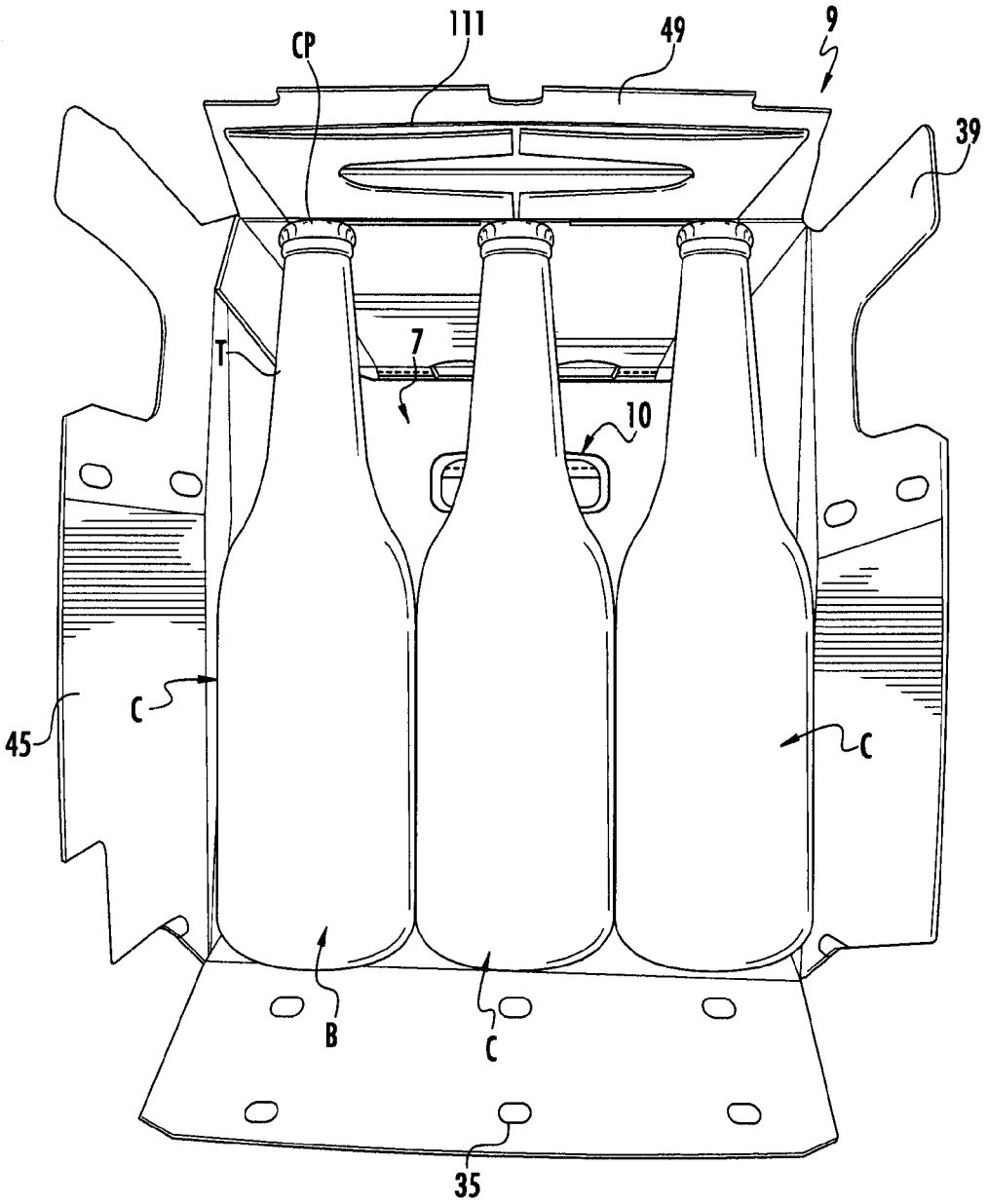

FIG. 1 is a plan view of the exterior side 1 of a blank, generally indicated at 3, used to form a carton 5 (FIG. 7) according to a first exemplary embodiment of the disclosure. The carton 5 can be used to house a plurality of articles such as containers C (FIG. 6B). In the illustrated embodiment, the containers C are bottles having a wide bottom B and a narrow top T including a cap CP. In the illustrated embodiment, the carton 5 is sized to house eighteen containers C in a single layer in a 3×6, arrangement, but it is understood that the carton 5 may be sized and shaped to hold containers of a different or same quantity in more than one layer and/or in different row/column arrangements (e.g., 1×6, 2'36, 4×6, 3×8, 2×6×2, 3×4×2, 2×9, 3×4,, etc.), or just a single article. The top and ends of the carton 5 can be reinforced by a reinforcing insert 105 (FIGS. 3-6B) formed from an insert blank 103 (FIG. 2). In the illustrated embodiment, the carton 5 includes a first end 7 and a second end 9, each with a respective handle, generally indicated at 10 (FIGS. 6A and 7) for grasping and carrying the carton at each of the ends 7, 9. As will be discussed below in more detail, the handles 10 are formed from various features in the carton blank 3.

In one embodiment, the first end 7 and the second end 9 of the carton 5 each have article protection features 11 (FIG. 11) for protecting at least one article C of the plurality of articles. Additionally, the carton 5 of the first embodiment may have article protection flaps 13 for protecting the at least one article. The article protection features 11 cushion the ends 7, 9 of the carton and prevent or reduce the likelihood of breakage of the containers C. In one embodiment, the article protection flaps 13 are movable between a first position (FIG. 5) and a second position (not shown) placed between adjacent containers C in the carton to reduce movement of the containers in the carton and prevent breakage of the containers. The article protection features and flaps can be similar to, or the same as, those described in U.S. patent application Ser. No. 13/419,740,, filed Mar. 14, 2012,, the disclosure of which is herein incorporated by reference. The article protection features 11 and/or the article protection flaps 13 can be otherwise shaped, arranged, and/or configured without departing from the disclosure. Further, the article protection features 11 and/or article protection flaps 13 can be omitted without departing from the disclosure.

The carton blank 3 has a longitudinal axis L1 and a lateral axis L2. In the embodiment of FIG. 1, the blank includes a bottom panel 15 foldably connected to a first side panel 17 at a lateral fold line 19. A second side panel 21 is foldably connected to the bottom panel 15 at a lateral fold line 23. A top panel 25 is foldably connected to the first side panel 17 at a lateral fold line 27 and foldably connected to an attachment panel 29 at a lateral fold line 31. Any of the top and bottom panels 25, 15, the first and second side panels 17, 21, and the attachment panel 29 can be otherwise shaped, arranged, configured, or omitted, without departing from the disclosure. For example, the carton blank 3 can alternatively include two top panels cooperating to form a top of the carton 5 or two bottom panels cooperating to form a bottom of the carton. Additionally, the attachment panel 29 could be foldably connected to the second side panel 21 in an alternative embodiment.

The bottom panel 15 is foldably connected to a first bottom end flap 33 and a second bottom end flap 35. The first side panel 17 is foldably connected to a first side end flap 37 and a second side end flap 39. The second side panel 21 is foldably connected to a first side end flap 43 and a second side end flap 45. The top panel 25 is foldably connected to a first top end flap 47 and a second top end flap 49. In one embodiment, when the carton 5 is erected, the end flaps 33, 37, 43, 47, close the first end 7 of the carton, and the end flaps 35, 39, 45, 49 close the second end 9 of the carton. In accordance with an alternative embodiment of the present disclosure, different flap arrangements can be used for closing the ends 7, 9 of the carton 5.

The end flaps 33, 37, 43, 47 extend along a first marginal area of the carton blank 3, and are foldably connected at a first longitudinal fold line 61 that extends along the length of the blank. The end flaps 35, 39, 45, 49 extend along a second marginal area of the carton blank 3, and are foldably connected at a second longitudinal fold line 63 that also extends along the length of the blank. The longitudinal fold lines 61, 63 may be, for example, substantially straight, or offset at one or more locations to account for blank thickness or for other factors. In one embodiment, the side panels 17, 21 have respective diamond panels 65 that are formed by a fold line 67 that is spaced inwardly from the respective longitudinal fold line 61, 63. Also, the side end flaps 37, 39, 43, 45 have a respective lateral fold line 69 extending from a diamond panel 65 to allow a respective end 7, 9 to angle inwardly so that the top of the carton 5 at each end (the portion of the fold line 61, 63 connecting the respective top end flap 47, 49) is closer to the center of the carton than the bottom of the carton at each end (the portion of the fold line 61, 63 connecting the respective bottom end flap 33, 35). In this way, the ends 7, 9 are tapered ends, but it is understood that the ends of the carton 5 could be otherwise shaped, arranged, and/or configured (e.g., straight or non-tapered) without departing from the disclosure. Additionally, one or both of the side panels could be at least partially tapered so that the top panel 25 could be narrower than the bottom panel 15 in the longitudinal direction L1 of the blank 3.

As shown in FIG. 1, each of the side end flaps 37, 39, 43, 45 can include a recessed top edge 70 extending from the respective lateral fold lines 27, 23 with an oblique portion 70*a*, and a generally lateral portion 70*b*. The lateral portions 70*b*, of the upper edges 70 can be offset from the respective lateral fold lines 27, 23 toward the bottom panel 15 to accommodate the end portions of the insert 105 in the closed ends 7, 9 of the carton 5 (FIGS. 5-6B). The side end flaps 37, 39, 43, 45 and the upper edges 70 can be otherwise shaped, arranged, and/or configured without departing from the disclosure.

In the embodiment of FIG. 1, the carton blank 3 has handle features for forming the handles 10. In the illustrated embodiment, the handle features comprise handle flaps 73 foldably connected to a respective top end flap 47, 49 at a longitudinal fold line 75 and separable from the respective top end flap 47, 49 along cut lines 74. The handle features can also include notches or openings 77 in the side end flaps 37, 39, 43, and 45. The openings 77 cooperate to provide an opening at a respective closed end 7, 9 to allow a respective handle flap 73 to be inwardly folded so that the carton 5 can be grasped at a respective end. The side end flaps 37, 39, 43, 45 can also include respective upper portions 72 disposed above the respective openings 77. Each of the handle flaps 73 can include a longitudinal fold line 76, oblique fold lines 78, and a lateral cut 79. The oblique fold lines 78 and the lateral cut 79 can form generally triangular flaps 80 in the handle flaps 73 that can help accommodate the narrow top T of a container C adjacent the respective handle 10. Accordingly, when the respective handle flap 73 is folded inwardly through the openings 77 in the carton 5, the triangular flaps 80 can separate along the respective cuts 79 and fold outwardly along the oblique fold lines 78 upon contact with the narrow top T of the respective container C. The carton blank 3 can have other features for forming the handles 10, or the carton blank 3 and/or carton 5 can have one or more handles that are alternatively shaped, arranged, and/or configured without departing from the disclosure. Further, one or both of the handles 10 can be omitted without departing from the disclosure.

Figure 7:
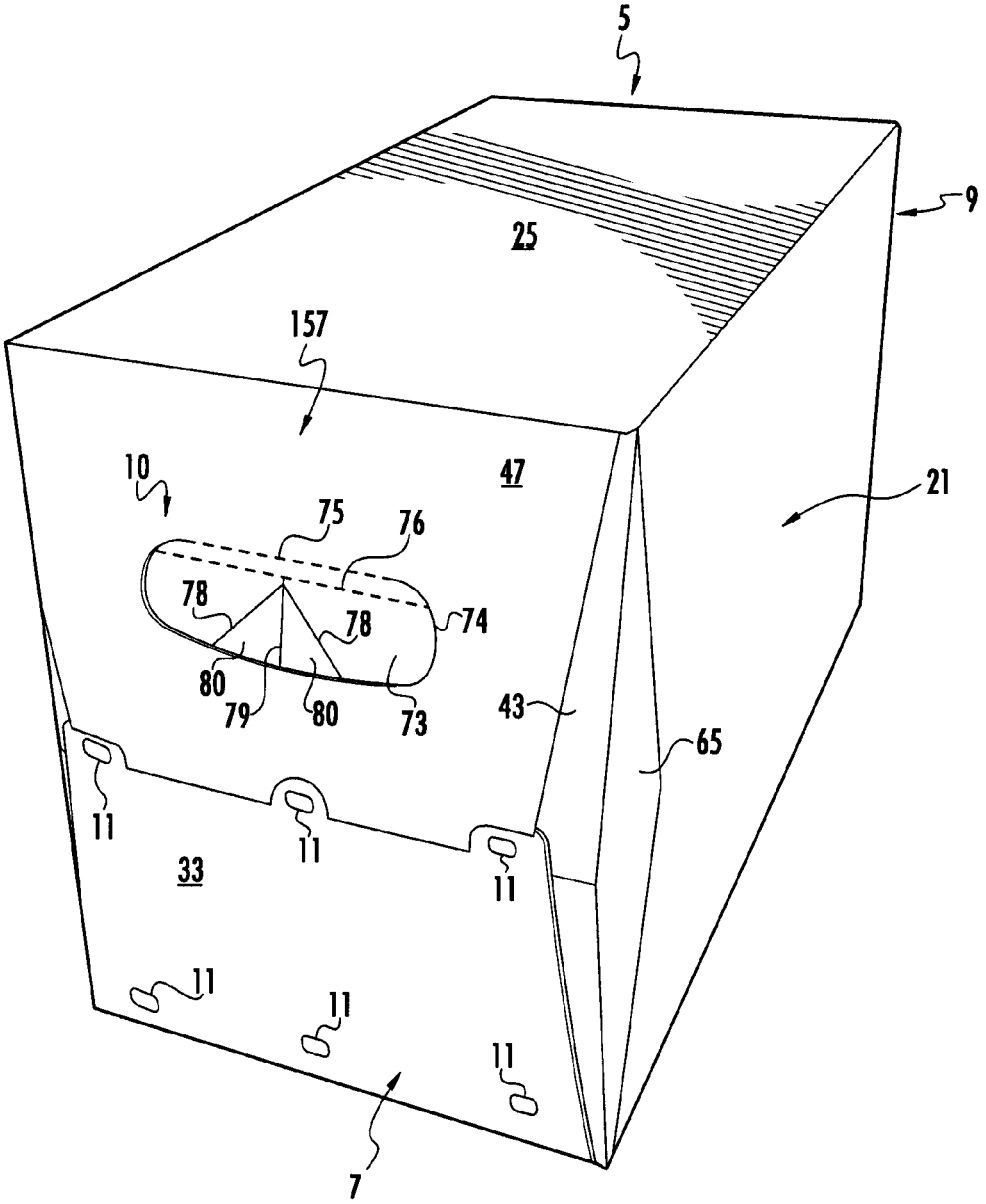
FIG. 7 is a perspective view showing the assembled carton according to the first exemplary embodiment of the disclosure.

In one embodiment, the carton blank 3 has features for forming the article protection features 11 of the carton 5. As shown in FIG. 1, the side end flaps 37, 39, 43, 45 have deformations in the form of indentations 81 on the exterior surface of the carton blank 3 such that the indentations from a protrusion on the interior surface of the blank. The bottom end flaps 33, 35 each have two rows of deformations in the form of indentations 83 on the interior surface of the carton blank 3 such that the indentations on the interior surface form a protrusion on the exterior surface 1 of the carton blank 3. As shown in FIG. 1, the top end flaps 47, 49 each have a respective distal edge 87, 89 having corner notches 91 and a center notch 93 for accommodating the article protection features 11 in the closed ends 7, 9 of the carton 5 (FIG. 7). The indentations 81, 83 can be any deformation on a surface of a respective side end flaps 37, 39, 43, 45 or bottom end flap 33, 35 such that the deformation can be any suitable shape (e.g., a concave depression or protrusion, convex depression or protrusion, flat depression or protrusion, embossed area, debossed area, etc., or any other suitable shape). Furthermore, the indentations 81, 83 could be formed on the interior or exterior surface of one or more of the first side panel 17, second side panel 21, top panel 25, bottom panel 15, or top end flaps 47, 49 without departing from the disclosure.

In the first embodiment, the carton blank 3 includes nine article protection flaps 13 arranged in a 3×3, arrangement, but the blank could have more or less than nine article protection flaps, and the flaps could be otherwise arranged in other suitable row/column arrangements or in a random configuration on the bottom panel 15, including a single row or single column configuration, or any other suitable configuration. In other embodiments, the carton blank 3 can include article protection flaps that are different, similar, or identical to other article protection flaps without departing from the disclosure. In the embodiment of FIG. 1, the middle row of article protection flaps 13 are oriented 180 degrees relative to a row of article protection flaps that are closer to the respective longitudinal fold lines 61, 63. In other embodiments, the article protection flaps 13 could be otherwise shaped, arranged, and/or configured without departing from the disclosure.

As shown in FIG. 1, the article protection flaps 13 are each foldably connected to the bottom panel 15 at a respective lateral fold line 95 and are each at least partially defined by a cut 97 in the bottom panel. Alternatively, the cut 97 could comprises other forms of weakening (e.g., a tear line that comprises cut lines separated by breakable nicks, a tear line that is formed by a series of spaced apart cuts, etc.) that allows the article protection flap 13 to be separated from the bottom panel 15 without departing from the disclosure. In one embodiment, a slit or cut 98 extends laterally from a portion of the cut 97 that is opposite to the lateral fold line 95. As shown in FIG. 1, the article protection flap 13 can comprise generally longitudinal fold lines 99 extending from the lateral fold line 95. Any of the fold lines 95, 99 and/or cuts 97, 98 could be otherwise shaped, arranged, configured, and/or omitted such that the article protection flap 13 has any other suitable shape or configuration without departing from the disclosure.

FIG. 2 illustrates an exterior surface 101 of the reinforcing insert blank 103 used to form the reinforcing insert 105 (FIG. 3) for use in the carton 5. As illustrated in FIG. 2, the longitudinal axis L1 and the lateral axis L2 of the insert blank 103 are oriented so that the longitudinal axis L1 and the lateral axis L2 of the insert blank 103 comport with the respective longitudinal axis L1 and lateral axis L2 of the carton blank 3 established in FIG. 1. In the illustrated embodiment, the insert blank 103 can be generally symmetric about a longitudinal central axis and a lateral central axis. The insert blank 103 can include a central panel 107 and two reinforcing end panels 109, 111 respectively foldably connected to the central panel 107 at opposite ends of the thereof. A first fold line or area 113 connects the first reinforcing end panel 109 to the central panel 107 at the first end of the insert blank 103, and a second fold line or area 115 connects the second reinforcing end panel 111 to the central panel 107 at the second end of the insert blank 103. In the illustrated embodiment, each of the fold areas 113, 115 can include several fold lines (e.g., scores, creases, cut-crease lines, etc.). Alternatively, the fold areas 113, 115 can be other lines or areas of weakening for folding the reinforcing end panels 109, 111 relative to the central panel 107 (e.g., a single fold line). Openings 117 can interrupt the fold areas 113, 115 to help avoid bunching of the insert blank material at the folds of the insert 105 in the erected carton 5. As shown in FIG. 2, the insert blank 103 can include first reinforcing end flaps 119, 121 foldably connected to opposite sides of the first reinforcing end panel 109 along respective lateral fold lines 123, 125, and second reinforcing end flaps 127, 129 foldably connected to the second reinforcing end panel 111 along respective lateral fold lines 131, 133. The insert blank 103 could be otherwise shaped, arranged, configured, and/or omitted without departing from the disclosure.

In the illustrated embodiment, the insert blank 103 includes features for forming the handles 10 in the carton 5. Each of the reinforcing end panels 109, 111 can include a handle cutout or opening 135 with an internal handle flap 137. The internal handle flaps 137 can be foldably connected to the respective reinforcing end panels 109, 111 along longitudinal fold lines 139, and each of the internal handle flaps 137 can include an intermediate fold line 141. The reinforcing end flaps 119, 121, 127, 129 can each include a handle notch or opening 143 that is generally aligned with the respective handle openings 135 in the reinforcing end panels 109, 111. An upper portion 145 can be disposed above each of the openings 143 in each of the reinforcing end flaps 119, 121, 127, 129.

According to the first embodiment, the insert blank 103 can be formed into the insert 105 by folding the reinforcing end flaps 119, 121, 127, 129 along the respective lateral fold lines 123, 125, 131, 133, and gluing the reinforcing end flaps 119, 121, 127, 129 in face-to-face contact with the respective reinforcing end panels 109, 111 such as by glue strips applied to the reinforcing end flaps and/or the reinforcing end panels. In the illustrated embodiment, the reinforcing end flaps 119, 121, 127, 129 are adhered to the interior surface 149 (FIG. 3) of the reinforcing end panels 109, 111. Alternatively, the reinforcing end flaps could be adhered to the exterior surface 101 of the reinforcing end panels.

Figure 3:
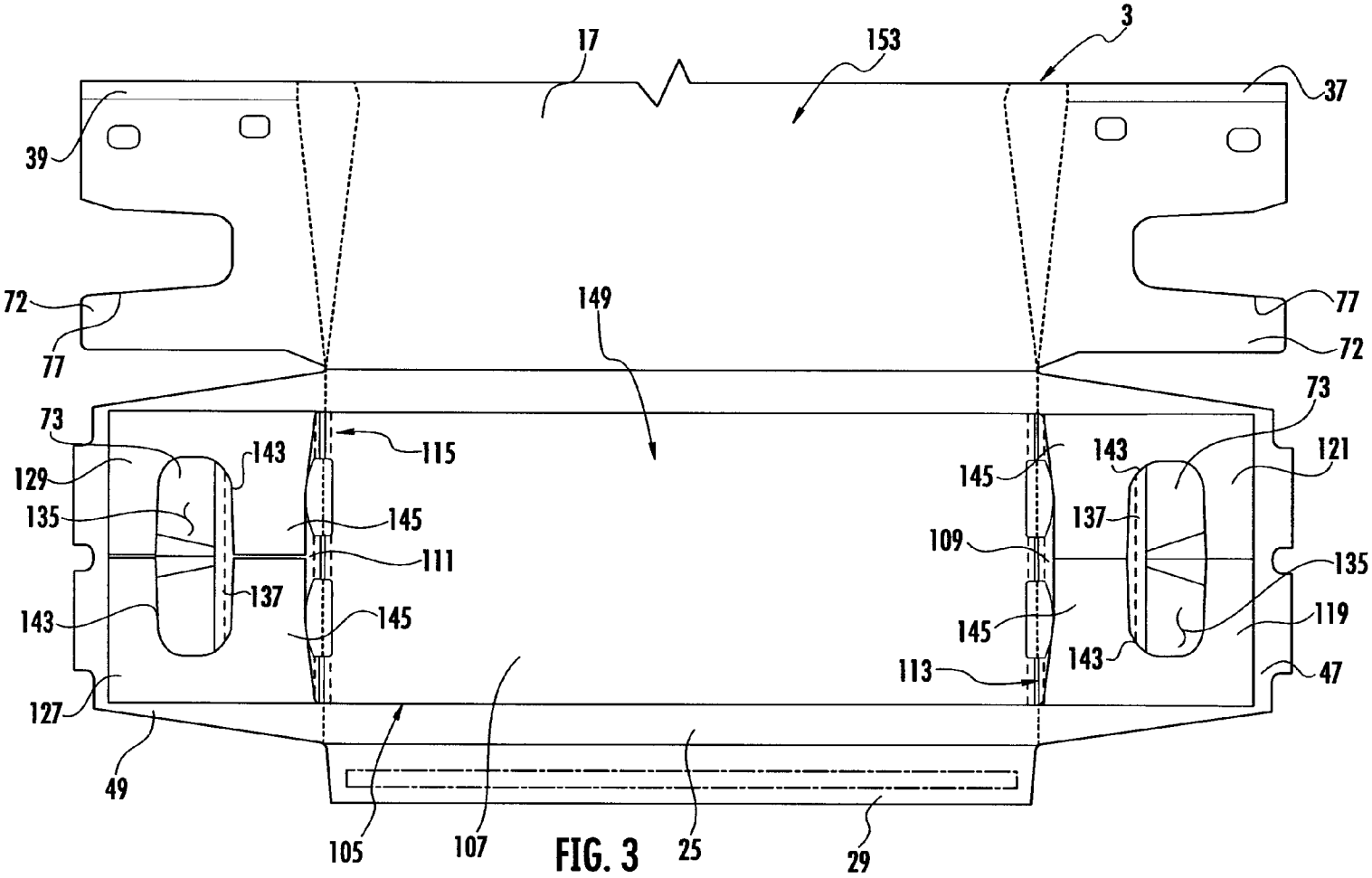
FIG. 3 is a plan view of the reinforcing insert formed from the reinforcing insert blank of FIG. 2 overlaid on the carton blank of FIG. 1.

As shown in FIG. 3, in one exemplary embodiment, the carton 5 can be assembled by initially adhering the reinforcing insert 105 to the top panel 25 and the top end flaps 47, 49 of the carton blank 3 after forming glue strips 151 on the exterior surface 101 of the reinforcing insert 105 and/or the interior surface 153 of the carton blank 3. As shown in FIG. 2, the glue strips 151 can be formed on the central panel 107 and the reinforcing end panels 109, 111, for example. The reinforcing insert 105 can be positioned on the carton blank 3 so that the central panel 107 is generally in face-to-face contact with the top panel 25. In one embodiment, the exterior surface of the reinforcing insert 105 is in contact with the interior surface 153 of the carton blank 3. The reinforcing insert 105 is sized so that the fold areas 113, 115 are generally aligned with and overlay the respective fold lines 61, 63 where the top end flaps 47, 49 are connected to respective ends of the top panel 25. As shown in FIG. 3, the reinforcing insert 105 is positioned relative to the top panel 25 so that the handle opening 135 in the reinforcing end panel 109 and the handle openings 143 in the reinforcing end flaps 119, 121, are generally aligned with and overlap the handle flap 73 in the top end flap 47. Similarly, the handle opening 135 in the reinforcing end panel 111 and the handle openings 143 in the reinforcing end flaps 127, 129, are generally aligned with and overlap the handle flap 73 in the top end flap 49. The reinforcing insert 105 could be otherwise assembled to the blank 3 without departing from the scope of the disclosure. For example, in one alternative embodiment, the reinforcing end panels 109, 111 are not adhered to the top end flaps 47, 49. In another alternative, the fold areas 113, 115 could be offset from the fold lines 61, 63.

Figure 4:
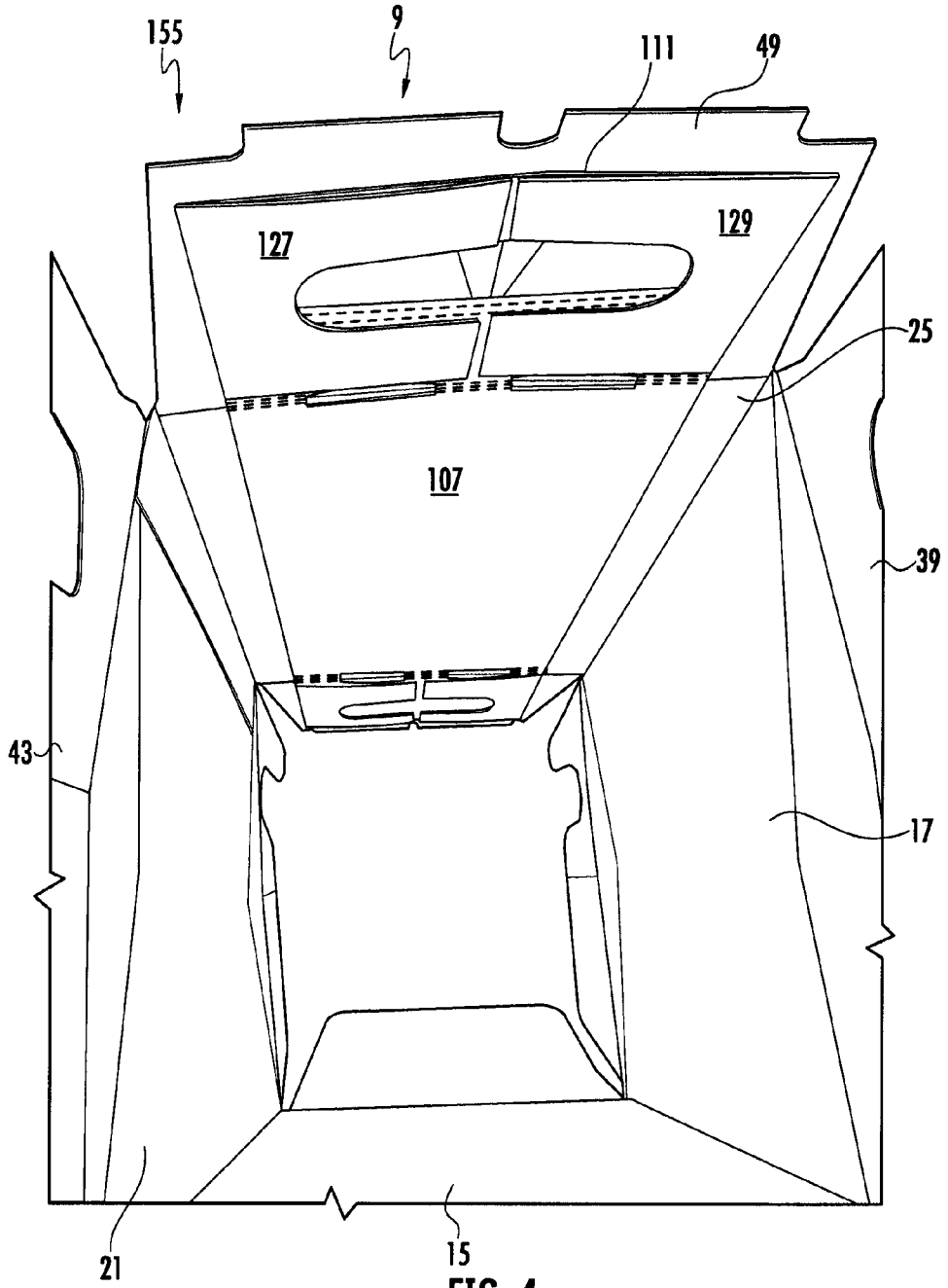
FIG. 4 is a perspective view showing a partially-erected carton in the form of an open-ended sleeve formed from the reinforcing insert and the carton blank of FIG. 3 according to the first exemplary embodiment of the disclosure.

In accordance with the exemplary embodiment, the carton blank 3 with reinforcing insert 105 can be further erected into the carton 5 by folding along the lateral fold lines 31, 19 and gluing the attachment flap 29 to the second side panel 21. As shown in FIG. 4, the blank can be folded along fold lines 19, 23, 27, 31 to form an open-ended sleeve 155. The carton blank 3 and reinforcing insert 105 may be otherwise formed into the open ended sleeve 155 using alternative folding and gluing steps without departing from the scope of this disclosure.

As shown in FIG. 5, the side end flaps 37, 43 are inwardly folded along the longitudinal fold line 61 and the fold lines 67 to at least partially close the first end 7, and the bottom end flap 33 is folded upwardly along the longitudinal fold line 61 into face-to-face contact with the lower portions of the side end flaps 37, 43. The upper edges 70 of the side end flaps 37, 43 can be disposed proximate the fold area 113 of the reinforcing insert 105. The top end flap 47 and the reinforcing end panel 109 can be downwardly folded along the respective longitudinal fold line 61 and fold area 113 so that the reinforcing end flaps 119, 121 are in face-to-face contact with the side end flaps 37, 43. The handle 10 in the first end 7 can be formed when the handle flap 73 of the top end flap 47, the handle openings 135, 143 of the insert 105, and the handle openings 77 of the side end flaps 37, 43 are generally aligned in the closed end 7. Accordingly, the top end flap 47, the reinforcing end panel 109, the reinforcing end flaps 119, 121, the side end flaps 37, 43, and the bottom end flap 33 can be selectively adhered to one another to close the first end 7 of the carton 5 (FIGS. 6A and 7).

In one embodiment, as shown in FIG. 6B, containers C can be loaded into the partially-erected carton 5 through the open second end 9. The second end 9 of the carton 5 can be closed in a similar manner as the first end 7 by folding, respectively overlapping, and selectively adhering the side end flaps 39, 45, the bottom end flap 35, the top end flap 49, the reinforcing end panel 111, and the reinforcing end flaps 127, 129. The erected carton is shown in FIG. 7. One or both of the ends 7, 9 could be otherwise shaped, arranged, configured, or omitted, without departing from the disclosure. Additionally, the open-ended sleeve 155 can be alternatively loaded with containers and closed without departing from the disclosure. For example, the ends 7, 9 can be closed in any order, and the containers C could be loaded before or after closing either or both of the ends 7, 9.

Each of the handles 10 can include the handle flap 73 (e.g., the first handle feature), the handle opening 135 and handle flap 137 (e.g., the second handle feature), the handle openings 143 (e.g., the third handle feature), and the handle openings 77 (e.g., the fourth handle feature), which are generally aligned in the ends 7, 9 of the carton. The handles 10 can be used to grasp the carton 5 by pressing against the elongate handle flaps 73 inwardly through the handle openings 135, 143 of the insert 105 and the handle openings 77 of the side end flaps 119, 121, 127, 129 to provide a handle opening in the closed ends 7, 9 of the carton 5. The inwardly folding handle flaps 73 can contact the handle flaps 137 in the respective handle opening 135 and fold the handle flaps 137 inwardly along fold lines 139, 141. Accordingly, the handle flaps 137 can help the handles 10 feel thicker where the user grasps the handles for helping to provide comfort to the user and/or helping to reinforce the handles. The upper portions 72 of the side end flaps 37, 43, 39, 45, the upper portions 145 of the reinforcing end flaps 119, 121, 127, 129, and the portions of the reinforcing end panels 109, 111 and the top end flaps 47, 49 above the handles 10 form respective reinforcing portions 157 in the respective closed ends 7, 9, which can provide at least four layers of material above the handles 10 (FIGS. 6A and 7) that can help reinforce the carton 5 above the handles 10. The handle flaps 73 can further reinforce the carton 5 above the handles 10 when folded inwardly against the upper portions 72 of the respective side end flaps 37, 43, 39, 35. Accordingly, the reinforcing portions 157 can include five layers of material above the handles 10 for reinforcing the closed ends 7, 9 above the handles. The handles 10 could be alternatively, shaped, arranged, configured, and/or reinforced without departing from this disclosure.

Figure 8:
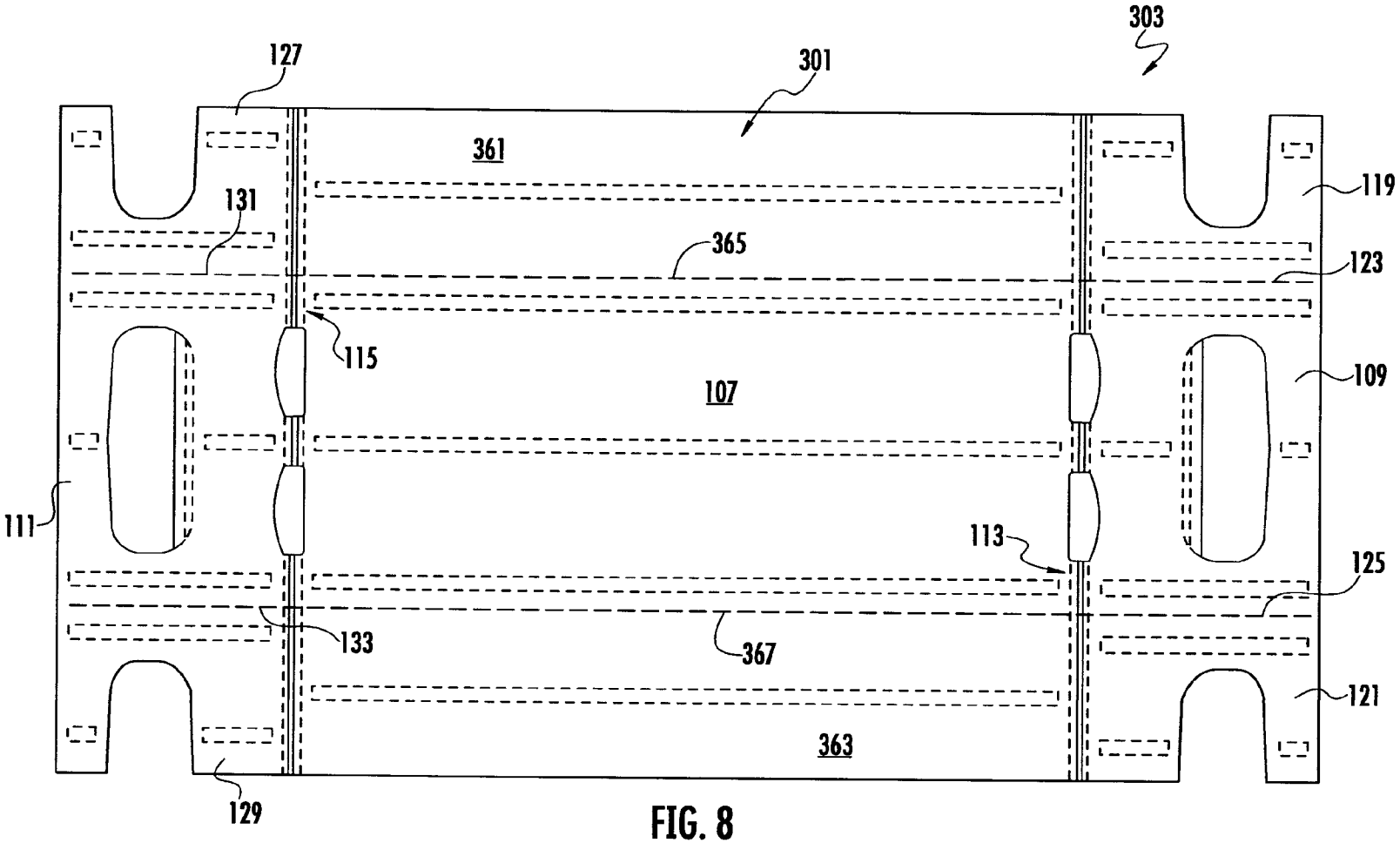
FIG. 8 is an exterior plan view of a reinforcing insert blank used to form a reinforcing insert in the carton according to a second exemplary embodiment of the disclosure.

FIG. 8 is a plan view of an exterior surface 301 of an alternative reinforcing insert blank 303 for forming a reinforcing insert (not shown) according to a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. The insert blank 303 can be for use with the carton blank 3 of the first embodiment or an alternative carton blank for forming a reinforced carton (not shown). As shown in FIG. 8, the blank 303 includes reinforcing top flaps 361, 363 foldably connected to the central panel 107 along lateral fold lines 365, 367, which can be collinear with or offset from the respective lateral fold lines 123, 131 and 125, 133. The reinforcing top flap 361 can be foldably connected to the reinforcing end flaps 119, 127 along the respective fold areas 113, 115, and the reinforcing top flap 363 can be foldably connected to the reinforcing end flaps 121, 129 along the respective fold areas 113, 115. When the insert blank 303 is formed into a reinforcing insert (not shown), the reinforcing top flaps 361, 363 are folded into face-to-face contact with the central panel 107 to help reinforce the top panel of the carton (not shown). The insert blank 303 could be otherwise shaped, arranged, and/or configured without departing from the disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding a plurality of containers, the carton comprising:

a plurality of panels that extends at least partially around an interior of the carton, the plurality of panels comprising a top panel;

a plurality of end flaps respectively foldably connected to respective panels of the plurality of panels, the plurality of end flaps being at least partially overlapped with respect to one another to thereby at least partially form a closed end of the carton, the plurality of end flaps comprising a top end flap foldably connected to the top panel;

a reinforcing insert comprising a central panel and at least one reinforcing end panel foldably connected to the central panel, the top panel at least partially overlapping the central panel, and the top end flap at least partially overlapping the at least one reinforcing end panel, at least one reinforcing end flap being foldably connected to the at least one reinforcing end panel; and a handle comprising at least a first handle feature in the top end flap, a second handle feature in the at least one reinforcing end panel, and a third handle feature in the at least one reinforcing end flap, the second handle feature being generally aligned with the first handle feature, and the third handle feature being aligned with the first handle feature and the second handle feature, wherein the second handle feature comprises a handle opening in the at least one reinforcing end panel and the third handle feature comprises a handle cutout in the at least one reinforcing end flap.

2. The carton of claim 1, wherein the first handle feature comprises a handle flap foldably connected to the top end flap.

3. The carton of claim 2, wherein the handle flap is a first handle flap and the second handle feature further comprises a second handle flap in face-to-face contact with the first handle flap.

4. The carton of claim 1, wherein the plurality of panels comprises a first side panel and a second side panel, the plurality of end flaps further comprises at least one side end flap foldably connected to at least one of the first side panel and the second side panel, and the at least one side end flap comprises a fourth handle feature that is generally aligned with the first handle feature, the second handle feature, and the third handle feature.

5. The carton of claim 4, wherein the at least one side end flap is at least partially in face-to-face contact with the at least one reinforcing end flap, the at least one reinforcing end flap is at least partially in face-to-face contact with the at least one reinforcing end panel, and the at least one reinforcing end panel is at least partially in face-to-face contact with the top end flap so that at least a portion of each of the at least one side end flap, the at least one reinforcing end flap, the at least one reinforcing end panel, and the top end flap form at least four layers of material above the handle.

6. The carton of claim 1, wherein the first handle feature comprises a handle flap foldably connected to the top end flap.

7. The carton of claim 6, wherein the handle flap is a first handle flap and the second handle feature further comprises a second handle flap in face-to-face contact with the first handle flap.

8. The carton of claim 7, wherein at least one of the first handle flap and the second handle flap comprises an intermediate fold line.

9. The carton of claim 6, wherein the at least one reinforcing end panel at least partially overlaps the at least one reinforcing end flap.

10. The carton of claim 1, wherein the reinforcing insert further comprises at least one reinforcing top flap foldably connected to the central panel and the at least one reinforcing end flap, the central panel at least partially overlapping the at least one reinforcing top flap.

11. A carton for holding a plurality of containers, the carton comprising:

a plurality of panels that extends at least partially around an interior of the carton, the plurality of panels comprising a top panel;

a plurality of end flaps respectively foldably connected to respective panels of the plurality of panels, the plurality of end flaps being at least partially overlapped with respect to one another to thereby at least partially form a closed end of the carton, the plurality of end flaps comprising a top end flap foldably connected to the top panel;

a reinforcing insert comprising a central panel and at least one reinforcing end panel foldably connected to the central panel, the top panel at least partially overlapping the central panel, and the top end flap at least partially overlapping the at least one reinforcing end panel, at least one reinforcing end flap being foldably connected to the at least one reinforcing end panel; and a handle comprising at least a first handle feature in the top end flap, a second handle feature in the at least one reinforcing end panel, and a third handle feature in the at least one reinforcing end flap, the second handle feature being generally aligned with the first handle feature and the third handle feature being aligned with the first handle feature and the second handle feature;

wherein the at least one reinforcing end flap comprises a first reinforcing end flap and a second reinforcing end flap, each of the first reinforcing end flap and the second reinforcing end flap being at least partially in face-to-face contact with an interior surface of the at least one reinforcing end panel.

12. A carton for holding a plurality of containers, the carton comprising:

a plurality of panels that extends at least partially around an interior of the carton, the plurality of panels comprising a top panel;

a plurality of end flaps respectively foldably connected to respective panels of the plurality of panels, the plurality of end flaps being at least partially overlapped with respect to one another to thereby at least partially form a closed end of the carton, the plurality of end flaps comprising a top end flap foldably connected to the top panel;

a reinforcing insert comprising a central panel and at least one reinforcing end panel foldably connected to the central panel, the top panel at least partially overlapping the central panel, and the top end flap at least partially overlapping the at least one reinforcing end panel, at least one reinforcing end flap being foldably connected to the at least one reinforcing end panel; and a handle comprising at least a first handle feature in the top end flap and a second handle feature in the at least one reinforcing end panel, the second handle feature being generally aligned with the first handle feature;

wherein the at least one reinforcing end flap comprises a first reinforcing end flap and a second reinforcing end flap, and the first reinforcing end flap and the second reinforcing end flap are foldably connected to the at least one reinforcing end panel along a respective first fold line and second fold line.

13. The carton of claim 12, wherein each of the first reinforcing end flap and the second reinforcing end flap comprises a respective handle cutout that is generally aligned with at least a portion of the first handle feature and the second handle feature.

14. The carton of claim 12, wherein each of the first reinforcing end flap and the second reinforcing end flap is at least partially in face-to-face contact with an interior surface of the at least one reinforcing end panel, and the at least one reinforcing end panel is at least partially in face-to-face contact with an inner surface of the top end flap.

15. A carton for holding a plurality of containers, the carton comprising:

a plurality of panels that extends at least partially around an interior of the carton, the plurality of panels comprising a top panel;

a plurality of end flaps respectively foldably connected to respective panels of the plurality of panels, the plurality of end flaps being at least partially overlapped with respect to one another to thereby at least partially form a closed end of the carton, the plurality of end flaps comprising a top end flap foldably connected to the top panel;

a reinforcing insert comprising a central panel and at least one reinforcing end panel foldably connected to the central panel, the top panel at least partially overlapping the central panel, and the top end flap at least partially overlapping the at least one reinforcing end panel, at least one reinforcing end flap being foldably connected to the at least one reinforcing end panel; and a handle comprising at least a first handle feature in the top end flap and a second handle feature in the at least one reinforcing end panel, the second handle feature being generally aligned with the first handle feature;

wherein the plurality of panels comprises a first side panel and a second side panel, and the central panel comprises a first free edge and a second free edge, each of the first free edge and the second free edge being generally parallel to the first side panel and the second side panel, and each of the first free edge and the second free edge being spaced apart from the first side panel and the second side panel.

16. In combination, a carton blank and a reinforcing insert blank for forming a carton for holding a plurality of containers:

the carton blank comprising:

a plurality of panels comprising a top panel;

a plurality of end flaps respectively foldably connected to respective panels of the plurality of panels, the plurality of end flaps for being at least partially overlapped with respect to one another to thereby at least partially form a closed end of the carton formed from the carton blank, the plurality of end flaps comprising a top end flap foldably connected to the top panel; and a first handle feature in the top end flap; and the reinforcing insert blank comprising:

a central panel, the top panel being for at least partially overlapping the central panel when the carton is formed from the carton blank;

at least one reinforcing end panel foldably connected to the central panel, the top end flap being for at least partially overlapping the at least one reinforcing end panel when the carton is formed from the carton blank;

at least one reinforcing end flap foldably connected to the at least one reinforcing end panel;

a second handle feature in the at least one reinforcing end panel, the second handle feature for being generally aligned with the first handle feature when the carton is formed from the carton blank; and a third handle feature in the at least one reinforcing end flap, the third handle feature for being generally aligned with the first handle feature and the second handle feature when the carton is formed from the carton blank;

wherein the second handle feature comprises a handle opening in the at least one reinforcing end panel and the third handle feature comprises a handle cutout in the at least one reinforcing end flap;

wherein the first handle feature, the second handle feature, and the third handle feature at least partially form a handle in the closed end when the carton is formed from the carton blank.

17. The combination of claim 16, wherein the first handle feature comprises a handle flap foldably connected to the top end flap.

18. The combination of claim 17, wherein the handle flap is a first handle flap and the second handle feature further comprises a second handle flap for being positioned in face-to-face contact with the first handle flap when the carton is formed from the carton blank.

19. The combination of claim 16, wherein the plurality of panels comprises a first side panel and a second side panel, the plurality of end flaps further comprises at least one side end flap foldably connected to at least one of the first side panel and the second side panel, and the at least one side end flap comprises a fourth handle feature that is for being generally aligned with the first handle feature, the second handle feature, and the third handle feature when the carton is formed from the carton blank.

20. The combination of claim 19, wherein the at least one side end flap is for being disposed at least partially in face-to-face contact with the at least one reinforcing end flap when the carton is formed from the carton blank, the at least one reinforcing end flap is for being disposed at least partially in face-to-face contact with the at least one reinforcing end panel when the carton is formed from the carton blank, and the at least one reinforcing end panel is for being disposed at least partially in face-to-face contact with the top end flap when the carton is formed from the carton blank so that at least a portion of each of the at least one side end flap, the at least one reinforcing end flap, the at least one reinforcing end panel, and the top end flap form at least four layers of material above the handle when the carton is formed from the carton blank.

21. The combination of claim 16, wherein the first handle feature comprises a handle flap foldably connected to the top end flap.

22. The combination of claim 21, wherein the handle flap is a first handle flap and the second handle feature further comprises a second handle flap for being disposed in face-to-face contact with the first handle flap when the carton is formed from the carton blank.

23. The combination of claim 22, wherein at least one of the first handle flap and the second handle flap comprises an intermediate fold line.

24. The combination of claim 16, wherein the reinforcing insert further comprises at least one reinforcing top flap foldably connected to the central panel and the at least one reinforcing end flap, the central panel being for at least partially overlapping the at least one reinforcing top flap when the carton is formed from the carton blank.

25. In combination, a carton blank and a reinforcing insert blank for forming a carton for holding a plurality of containers:

the carton blank comprising:

a plurality of panels comprising a top panel;

a plurality of end flaps respectively foldably connected to respective panels of the plurality of panels, the plurality of end flaps for being at least partially overlapped with respect to one another to thereby at least partially form a closed end of the carton formed from the carton blank, the plurality of end flaps comprising a top end flap foldably connected to the top panel; and a first handle feature in the top end flap; and the reinforcing insert blank comprising:

a central panel, the top panel being for at least partially overlapping the central panel when the carton is formed from the carton blank;

at least one reinforcing end panel foldably connected to the central panel, the top end flap being for at least partially overlapping the at least one reinforcing end panel when the carton is formed from the carton blank;

at least one reinforcing end flap foldably connected to the at least one reinforcing end pane1, wherein the at least one reinforcing end flap comprises a first reinforcing end flap and a second reinforcing end flap, each of the first reinforcing end flap and the second reinforcing end flap for being disposed at least partially in face-to-face contact with an interior surface of the at least one reinforcing end panel when the carton is formed from the carton blank;

a second handle feature in the at least one reinforcing end panel, the second handle feature for being generally aligned with the first handle feature when the carton is formed from the carton blank; and a third handle feature in the at least one reinforcing end flap, the third handle feature for being generally aligned with the first handle feature and the second handle feature when the carton is formed from the carton blank;

wherein the first handle feature, the second handle feature, and the third handle feature at least partially form a handle in the closed end when the carton is formed from the carton blank.

26. In combination, a carton blank and a reinforcing insert blank for forming a carton for holding a plurality of containers:

the carton blank comprising:

a plurality of panels comprising a top panel;

a plurality of end flaps respectively foldably connected to respective panels of the plurality of panels, the plurality of end flaps for being at least partially overlapped with respect to one another to thereby at least partially form a closed end of the carton formed from the carton blank, the plurality of end flaps comprising a top end flap foldably connected to the top panel; and a first handle feature in the top end flap; and the reinforcing insert blank comprising:

a central panel, the top panel being for at least partially overlapping the central panel when the carton is formed from the carton blank;

at least one reinforcing end panel foldably connected to the central panel, the top end flap being for at least partially overlapping the at least one reinforcing end panel when the carton is formed from the carton blank;

at least one reinforcing end flap foldably connected to the at least one reinforcing end panel; and a second handle feature in the at least one reinforcing end panel, the second handle feature for being generally aligned with the first handle feature when the carton is formed from the carton blank;

wherein the first handle feature and the second handle feature at least partially form a handle in the closed end when the carton is formed from the carton blank;

wherein the at least one reinforcing end flap comprises a first reinforcing end flap and a second reinforcing end flap, and the first reinforcing end flap and the second reinforcing end flap are foldably connected to the at least one reinforcing end panel along a respective first fold line and second fold line.

27. The combination of claim 26, wherein each of the first reinforcing end flap and the second reinforcing end flap comprises a respective handle cutout that is for being generally aligned with at least a portion of the first handle feature and the second handle feature when the carton is formed from the carton blank.

28. In combination, a carton blank and a reinforcing insert blank for forming a carton for holding a plurality of containers:

the carton blank comprising:

a plurality of panels comprising a top panel;

a plurality of end flaps respectively foldably connected to respective panels of the plurality of panels, the plurality of end flaps for being at least partially overlapped with respect to one another to thereby at least partially form a closed end of the carton formed from the carton blank, the plurality of end flaps comprising a top end flap foldably connected to the top panel; and a first handle feature in the top end flap; and the reinforcing insert blank comprising:

a central panel, the top panel being for at least partially overlapping the central panel when the carton is formed from the carton blank;

at least one reinforcing end panel foldably connected to the central panel, the top end flap being for at least partially overlapping the at least one reinforcing end panel when the carton is formed from the carton blank;

at least one reinforcing end flap foldably connected to the at least one reinforcing end panel; and a second handle feature in the at least one reinforcing end panel, the second handle feature for being generally aligned with the first handle feature when the carton is formed from the carton blank;

wherein the first handle feature and the second handle feature at least partially form a handle in the closed end when the carton is formed from the carton blank;

wherein the plurality of panels comprises a first side panel and a second side panel, and the central panel comprises a first free edge and a second free edge, each of the first free edge and the second free edge being generally parallel to the first side panel and the second side panel, and each of the first free edge and the second free edge being spaced apart from the first side panel and the second side panel when the carton is formed from the carton blank.

29. A method for forming a carton for holding a plurality of containers, the method comprising:

obtaining a carton blank comprising a plurality of panels comprising a top panel, a plurality of end flaps comprising a top end flap foldably connected to the top panel, and a first handle feature in the top end flap;

obtaining a reinforcing insert blank comprising a central panel, at least one reinforcing end panel foldably connected to the central panel, at least one reinforcing end flap foldably connected to the at least one reinforcing end panel, a second handle feature in the at least one reinforcing end panel, and a third handle feature in the at least one reinforcing end flap, the second handle feature comprising a handle opening in the at least one reinforcing end panel and the third handle feature comprising a handle cutout in the at least one reinforcing end flap;

forming a reinforcing insert from the reinforcing insert blank by at least partially overlapping the at least one reinforcing end flap with the at least one reinforcing end panel, the at least partially overlapping the at least one reinforcing end flap with the at least one reinforcing end panel comprises aligning the third handle feature with the second handle feature;

positioning the reinforcing insert on the carton blank so that the top panel at least partially overlaps the central panel and the top end flap at least partially overlaps the at least one reinforcing end panel;

forming an interior of the carton at least partially defined by the plurality of panels, the forming the interior of the carton comprising forming an open-ended sleeve; and at least partially closing an end of the carton by at least partially overlapping the plurality of end flaps with respect to one another, the at least partially closing the end of the carton comprising forming a handle in the end of the carton from at least the first handle feature, the second handle feature, and the third handle feature, wherein the forming the handle comprises generally aligning the third handle feature and the second handle feature with the first handle feature.

30. The method of claim 29, wherein the plurality of panels comprises a first side panel and a second side panel, the plurality of end flaps further comprises at least one side end flap foldably connected to at least one of the first side panel and the second side panel, the at least one side end flap comprises a fourth handle feature, and the forming the handle comprises aligning the fourth handle feature with the first handle feature, the second handle feature, and the third handle feature.

31. The method of claim 30, wherein the at least partially overlapping the at least one reinforcing end flap with the at least one reinforcing end panel comprises positioning the at least one reinforcing end flap at least partially in face-to-face contact with the at least one reinforcing end panel, the positioning the reinforcing insert on the carton blank comprises positioning the at least one reinforcing end panel at least partially in face-to-face contact with the top end flap, and the at least partially closing the end of the carton comprises positioning the at least one side end flap at least partially in face-to-face contact with the at least one reinforcing end flap so that at least a portion of each of the at least one side end flap, the at least one reinforcing end flap, the at least one reinforcing end panel, and the top end flap form at least four layers of material above the handle when the carton is formed from the carton blank.

32. A method for forming a carton for holding a plurality of containers, the method comprising:

obtaining a carton blank comprising a plurality of panels comprising a top panel, a plurality of end flaps comprising a top end flap foldably connected to the top panel, and a first handle feature in the top end flap;

obtaining a reinforcing insert blank comprising a central panel, at least one reinforcing end panel foldably connected to the central panel, at least one reinforcing end flap foldably connected to the at least one reinforcing end panel, and a second handle feature in the at least one reinforcing end panel, and a third handle feature in the at least one reinforcing end flap, wherein the at least one reinforcing end flap comprises a first reinforcing end flap and a second reinforcing end flap;

forming a reinforcing insert from the reinforcing insert blank by at least partially overlapping the at least one reinforcing end flap with the at least one reinforcing end panel, the at least partially overlapping the at least one reinforcing end flap with the at least one reinforcing end panel comprises aligning the third handle feature with the second handle feature and positioning each of the first reinforcing end flap and the second reinforcing end flap at least partially in face-to-face contact with an interior surface of the at least one reinforcing end panel;

positioning the reinforcing insert on the carton blank so that the top panel at least partially overlaps the central panel and the top end flap at least partially overlaps the at least one reinforcing end panel;

forming an interior of the carton at least partially defined by the plurality of panels, the forming the interior of the carton comprising forming an open-ended sleeve; and at least partially closing an end of the carton by at least partially overlapping the plurality of end flaps with respect to one another, the at least partially closing the end of the carton comprising forming a handle in the end of the carton from at least the first handle feature, the second handle feature, and the third handle feature, wherein the forming the handle comprises generally aligning the third handle feature and the second handle feature with the first handle feature.

* * * * *